United States Patent [19]

Fricker

[11] Patent Number: 4,848,604

[45] Date of Patent: Jul. 18, 1989

[54] SLIDE GATE VALVE AT THE NOZZLE OF A VESSEL CONTAINING MOLTEN METAL

[75] Inventor: Robert Fricker, Unterägeri, Switzerland

[73] Assignee: Stopinc Aktiengesellschaft, Baar, Switzerland

[21] Appl. No.: 178,060

[22] PCT Filed: Jun. 25, 1987

[86] PCT No.: PCT/EP87/00327

§ 371 Date: Feb. 3, 1988

§ 102(e) Date: Feb. 3, 1988

[87] PCT Pub. No.: WO88/01211

PCT Pub. Date: Feb. 25, 1988

[30] Foreign Application Priority Data

Aug. 20, 1986 [CH] Switzerland ..... 03336/86
Aug. 20, 1986 [CH] Switzerland ..... 03337/86

[51] Int. Cl.[4] ..... B22D 41/08
[52] U.S. Cl. ..... 222/600; 222/597
[58] Field of Search ..... 266/236, 271, 287; 222/591, 597, 600, 590

[56] References Cited

U.S. PATENT DOCUMENTS

| | | | |
|---|---|---|---|
| 3,856,189 | 12/1974 | Meier | 222/600 |
| 3,921,866 | 11/1975 | Palazzo | 222/600 |
| 4,187,965 | 12/1980 | Aliprandi et al. | 222/600 |
| 4,660,749 | 4/1987 | Yokoi et al. | 222/600 |
| 4,717,127 | 1/1988 | Toxler | 266/236 |

FOREIGN PATENT DOCUMENTS

| | | |
|---|---|---|
| 2161368 | 6/1973 | Fed. Rep. of Germany . |
| 2736817 | 11/1978 | Fed. Rep. of Germany . |
| 3208101 | 12/1982 | Fed. Rep. of Germany . |
| 2107885 | 5/1972 | France . |

*Primary Examiner*—Scott Kastler
*Attorney, Agent, or Firm*—Wenderoth, Lind & Ponack

[57] ABSTRACT

The slide gate valve (20) has a damper unit (30) that can be adjusted by a drive unit and that can be moved to a position (A) lying outside of the closed position. In this position (A), the damper unit (30) is swingably held in a bearing (29) and guideways (21*c*) are lowered by a height (h) which releases the spring means (50) with respect to guideways (21*a*) along the remaining panel length. In this way, this damper unit can be swung out of the housing (24) in very simple fashion for the replacement of the eroded plates (22, 32), which is required very frequently and, after replacement of the plates, can be brought in the operating state again.

15 Claims, 3 Drawing Sheets

SLIDE GATE VALVE AT THE NOZZLE OF A VESSEL CONTAINING MOLTEN METAL

BACKGROUND OF THE INVENTION

The present invention relates to a slide gate valve or sliding closure unit for use at the nozzle of a vessel containing molten metal and of the type including a housing, a stationary bottom refractory plate fixedly mounted in the housing, and a sliding refractory plate that can be pressed sealingly against the bottom plate by spring means. The sliding plate is supported in an assembly that is movable along guideways of the housing between open and closed positions and that can be swung away from the housing upon release of the spring means.

As a rule, in this type of slide gate valve the movable plate assembly is guided to move in a cover secured to the housing. Thus, for example, in a slide gate valve described in DE-OS No. 21 61 368, a cover is hinged to swing out from a housing which supports a movable plate assembly for movement and which, in the operating position, is secured to the housing, preferably by four bolts.

In another slide gate valve disclosed in West German Pat. No. 32 08 101, a movable plate assembly is guided on guide ribs which are bolted to side walls of a housing. After loosening of tensioning means that press a sliding plate against a bottom plate and removal of the guide ribs, the movable plate assembly can be removed from the housing. In another modification, the housing is provided with a removable end wall, after the removal of which and the loosening of the tensioning means the movable plate assembly can be removed.

During operation, the slide gate valves are often disassembled even after one or two ladle teeming operations for maintenance purposes or for the replacement of eroded refractory plates. Therefore, in the case of the above-mentioned slide gate valves, the aforementioned bolts must each time be loosened and the movable plate assembly removed from the housing and be appropriately reassembled. Since during maintenance work such slide gate valves are generally heated to very high temperatures and become fouled, manual disassembly is relatively cumbersome. Also, the assembly must be carried out with proper care, because the adjusting bolts, which must usually be secured with a torque spanner, must be set with precision.

SUMMARY OF THE INVENTION

By contrast, the object of the present invention is to provide an improved slide gate valve of the type described above, but wherein the movable plate assembly can be loosened from the housing very simply and in a time-saving manner for the very frequent replacement of the refractory plates and refractory nozzles and similarly can be brought back into operating condition after exchange of the refractories.

In accordance with the invention, this object is achieved by providing a movable plate assembly that can be moved into a position that lies outside of or is beyond the normal closed position and at which the movable plate assembly is swingably mounted about a bearing to the housing. At such position guideways supporting the assemblies are lowered by a height sufficient to release the tension of spring means.

With this novel construction of the slide gate valve embodying the invention, the assembly with the sliding plate mounted therein is released from the pressure of the spring means merely by sliding the assembly to the above-mentioned position. Therefore, the slide gate valve can be disassembled in extremely simple fashion by moving the assembly into the above-mentioned position and then swiveling the same out of the housing. Conversely, in order to mount the assembly, it is swung back into the housing, after which it is moved back to the closed position. Thereby, the pressure of the spring means is automatically re-established accurately without having to carry out additional operations on the slide gate valve.

To achieve a continuous and non-jerky tensioning or unstressing of the movable plate assembly housing, the guideways in the area of transition to the above-mentioned position are constructed as inclined planes.

Provision is made by the invention that the movable plate assembly is in the form of a sliding carriage having at least two elements, more particularly rollers, mounted on guides on opposite sides of the housing.

In accordance with a further feature of the invention, there is provided a housing frame that surrounds the sliding carriage and to which are secured the guides on which slides the sliding carriage.

To achieve a predetermined tensional force of the sliding plate against the bottom plate, the invention provides that the housing frame is connected to a top section of the housing, on each of opposite sides thereof, by two spring means disposed symmetrically and axially parallel to the nozzle opening, whereby each of the spring means advantageously includes a bolt with upper and lower abutment faces, the lower face acting on the housing frame and a spring disposed in the top section of the housing acting on the upper abutment face.

In accordance with a further preferred feature of the invention, the housing frame is fixed flexibly around two bolts secured to the upper section of the housing. These bolts are located on a plane perpendicular to the direction of sliding and containing the axis of the nozzle opening. The bolts position the housing frame and prevent at the same time resultant axial force from acting on the resilient tensioning means of the slide gate valve.

In accordance with another preferred feature of the invention, the sliding carriage is pivotally hinged to a connecting rod of a drive unit of the sliding carriage, and the guides have in the above-mentioned position, beneath each roller, an opening of a length which is greater than the diameter of the rollers and through which can move the rollers of the carriage. Thereby, aside from the very simple tensioning or unstressing, an extremely simple disassembly or assembly of the sliding carriage is ensured.

In a further preferred embodiment, the sliding carriage has on either side thereof two rollers which are supported on the guides of the hosuing frame, as well as an articulated hook that can engage the connecting rod of the drive unit. Each of the guides has, in the above-mentioned position of the sliding carriage beneath the rollers mounted coaxially on the end of the carriage closest to the drive unit, an opening of a length which is greater than the diameter of the rollers. The guides have grooves that center and pivotally support the other two coaxially mounted rollers, such that the movable plate assembly can be swung out in the above-mentioned position about the axis of rotation of such other rollers, with the articulated hook swiveling together therewith.

Alternatively, provision is made by the invention so that the carriage is swingably hinged to the connecting rod of the drive unit, the housing frame is swingably mounted to the housing, and the guideway surfaces in contact with the rollers in the above-mentioned position are substantially parallel to the guideway surfaces along the remaining guideway length and parallel to the direction of sliding.

BRIEF DESCRIPTION OF THE DRAWINGS

Embodiments of the invention will not be described with reference to the accompanying drawings, in which.

DETAILED DESCRIPTION OF THE INVENTION

Figure 1:
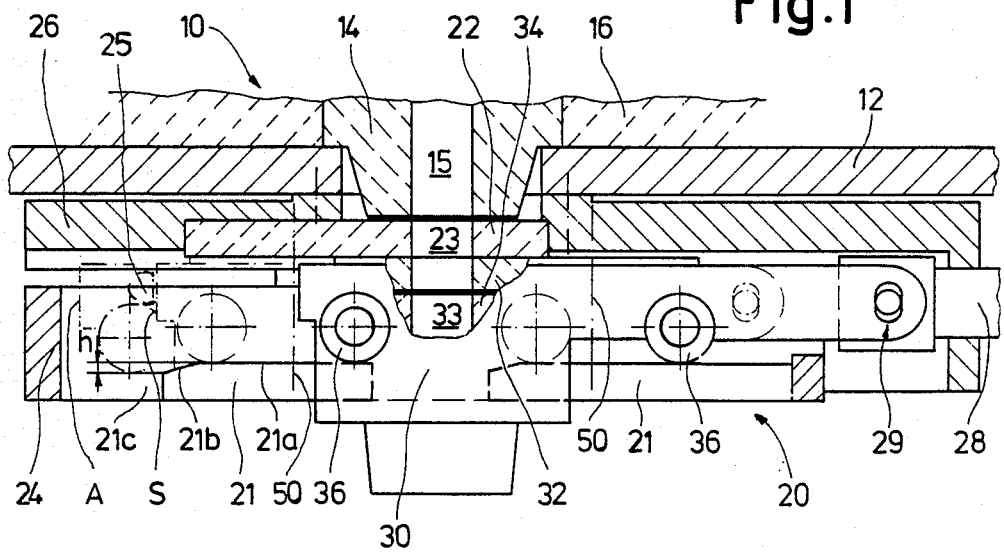
FIG. 1 is a longitudinal section of a first embodiment of a novel slide gate valve or sliding closure unit having a housing frame and a movable plate assembly attached thereto.

The slide gate valve or sliding closure unit 20 shown in FIG. 1 is secured to a steel jacket 12 of a molten-steel ladle 10 shown in part. There is sealingly joined to a nozzle 14 having an opening 15 and embedded in the refractory lining 16 of the ladle 10 a refractory bottom plate 22 disposed in a housing top section 26 of the slide gate valve 20. Bottom plate 22 has an opening 23 which is coaxial with the nozzle opening 15. In the open position of the slide gate valve shown in the drawing, the coaxial opening 23 also is aligned with an opening 33 of a refractory sliding plate 32 held in a sliding carriage or frame 30 and of an outlet nozzle 34.

In its operating state, the slidng carriage 30 can be moved between such open position and a closed position S, indicated by the dot-dash lines in FIG. 1, by means of a drive unit. As a rule, the drive unit (not shown) is hydraulic cylinder with a connecting rod 28. The sliding carriage 30 is connected at one end thereof to the connecting rod 28 by an articulation 29, and connecting rod 28 is supported in the housing top section 26. The sliding carriage 30 has along each of its two long sides two rollers 35 having rotational axes that are perpendicular to the direction of sliding. These rollers 35 are supported on longitudinal surface 21*a*, extending parallel to the sliding direction, of longitudinal guides 21 of the housing of the slide gate valve. The guides 21 themselves are secured to a housing frame 24 surrounding the sliding carriage 30 and attached to housing top section 26 by spring assemblies 50. Instead of the rollers 36, sliding pads for example, also could be used.

Figure 2:
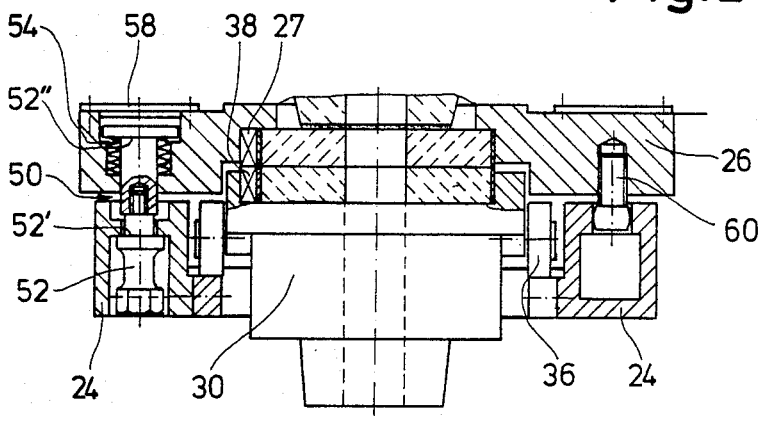
FIG. 2 is a transverse cross-sectional view of the slide gate valve depicted in FIG. 1.

In accordance with the invention, the sliding carriage 30 can be pushed by the drive unit to a spring release position A beyond the closed position S, during which the rollers 36 are in contact with guideway surfaces 21*b* and are lowered by a height h, that releases tension of the spring assemblies 50, with respect to the surfaces 21*a* guideway in the area of the operating positions. Guideway surfaces 21*b* are inclined planes which during tensioning cause a continuous increase of compression of the spring assemblies, and during unstressing cause a continuous reduction of the tensional force of the spring assemblies. After the inclined surfaces 21b, the guides 21 are interrupted for each of the rollers 36 by openings 21*c* with a length that is greater than the diameter of the rollers. Thus, with the spring pressure released, the sliding carriage 30 can be swung about 29 out through housing frame 24, and replacement, required at regular intervals, of eroded plates 22, 32 and of the nozzle 34 can be achieved. As shown in FIG. 2, each spring assembly 50 includes a two-part bolt member 52 and a spring 54 disposed in the housing top section 26. The bolt member 52 has a lower abutment face 52' abutting housing frame 24, and an upper abutment fact 52" against which spring 54 is pressed. For assembly purposes, the two parts of bolt member 52 are screwed together to compress spring 54. On either side of the housing frame 24, there are provided symmetrically and axially parallel to the nozzle opening 15 two spring assemblies 50 between which is disposed a bolt 60 at a position longitudinally aligned with the nozzle opening and screwed into the housing top section 26. Bolt 60 centers the housing frame 24 and has a head with convex surfaces to enable frame 24 to be movable in flexible all directions relative to bolt 60. Springs 54 are to be dimensioned such that frame 24, carriage 30 and the sliding plate 32 are pressed with a preset tensional force toward the stationary bottom plate 22. Cover plates 58 secured to the housing top section 26 prevent the spring assemblies from becoming fouled.

The sliding plate 32 and the bottom plate 22 are mounted by tensioning means 38, 27 in a known manner in carriage 30 and in housing top section 26, respectively.

Figure 3:
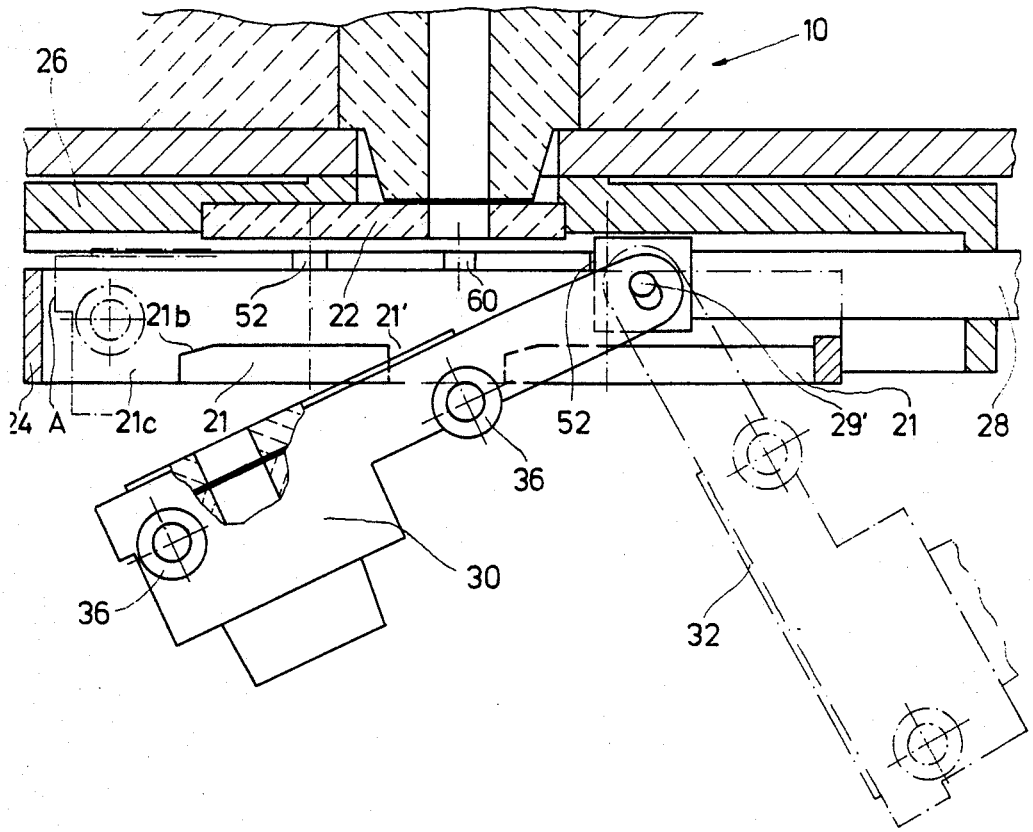
FIG. 3 is a longitudinal section showing the slide gate valve of FIG. 1 with the movable plate assembly thereof pivoted to an open position.

After ladle 10 has been emptied, it is moved to a ladle location, normally for maintenance purposes and for replacement of the wear parts. At such position, the ladle is laid on its side in such a way that the movable plate assembly can be swung out horizontally. The movable plate assembly previously had been moved to the closed position S after completion of the teeming and now is moved by a cylinder disposed at the ladle location to the position A and, as shown in FIG. 3, is swung out to the dot-dash position in order to be able to replace without further ado the plates 22 and 32. As soon as the slide gate valve has been services, it is made ready for operation and the movable plate assembly is again returned to the closed position S. Unlike the hydraulic cylinder disposed at such ladle location, the hydraulic cylinder at the teeming platform for the control of the slide gate valve need have only one stroke length, i.e. to move the movable plate assembly from the closed position to the open position and vice versa, but not to the position A beyond the closed position. Should it be necessary to use the same cylidner at the teeming platform and at the ladle location, there may be provided an abutment menas 25 that is detachably mounted to the housing, to prevent the movable plate assembly when at the teeming location from being moved to the position A beyond the closed position. Such an abutment means 25 is indicated schematically in FIG. 1 and can be constructed as a shaft 25 that can be inserted in the housing frame 24 and that can be removed therefrom.

Figure 4:
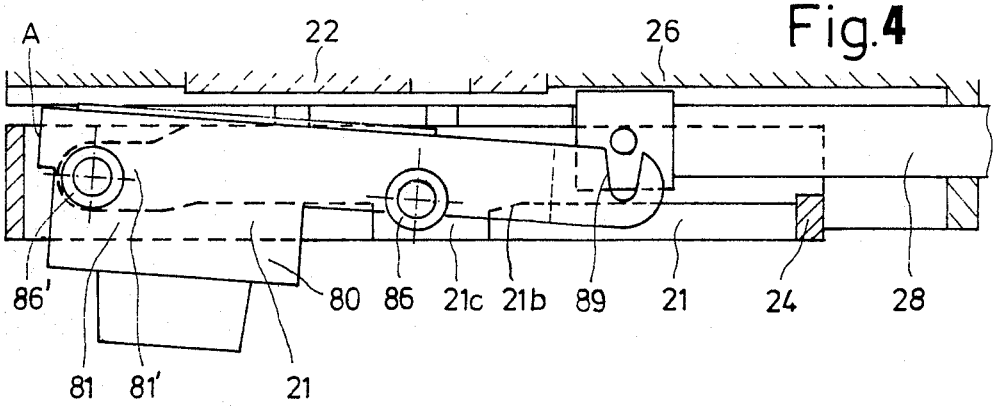
FIG. 4 is a longitudinal view, partially in section, of a slide gate valve similar to FIG. 1 but with a modification of the articulation of the movable plate assembly.

FIG. 4 shows a modification of the articulation of a movable plate assembly 80 having two rollers 86, 86' on either side. When the assembly is moved to position A, the two coaxial rollers 86 adjacent the drive unit can be moved through recesses 21c provided in the guides 21, while the two coaxial rollers 86' spaced farthest from the drive unit are surrounded and centered by grooves 81' in the guides 21 or in frame 24. The damper unit 80 is hinged by an articulated hook 89 to the connecting rod 28 of the drive unit, and thus it can be swung out through housing 24 in the position A about the axis of rotation of the rollers 86'.

Figure 5:
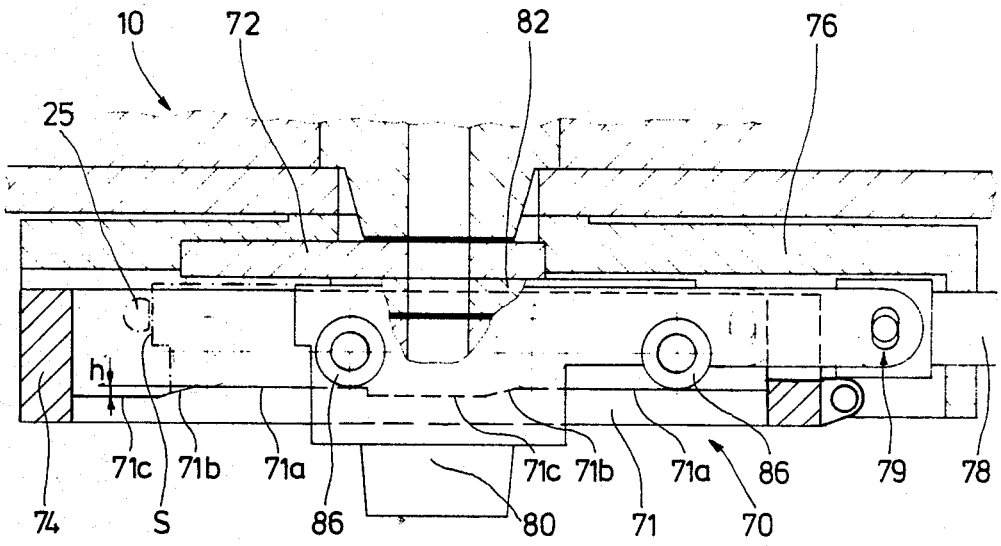
FIG. 5 is a longitudinal section of a second embodiment of the novel slide gate valve, shown with a pivoting housing cover.

A slide gate valve 70 shown in FIG. 5 operates essentially in the same manner as that shown in FIG. 1. Therefore, the following discussion will be of only the characteristics of this slide gate valve 70 that are distinguished from those of slide gate valve 20. A sliding carriage 50, swingably hinged at one end thereof by an articulation 79 to a connecting rod 78 of a drive unit, not shown, and having mounted on each side thereof two rollers 86, mounted on either side, is slidably mounted in a cover of frame 74 that is hinged to a housing 76 such that cover 74 can be swung away from housing 76.

In accordance with this embodiment of the present invention, the sliding carriage 80 can be moved by the drive unit to a position beyond the closed position S and at which the rollers 86 contact guideway surfaces 72*c* guides 71 that are lowered by a height h with respect to surfaces 71*a*, to thereby release the spring pressure of the spring assemblies. The guide surfaces 71*c* are parallel to the guideway surfaces 71*a* as well as parallel to the direction of sliding of the carriage 80. Inclined surfaces 71*b* again ensure that the spring assemblies are unstressed and tensioned continuously.

Figure 6:
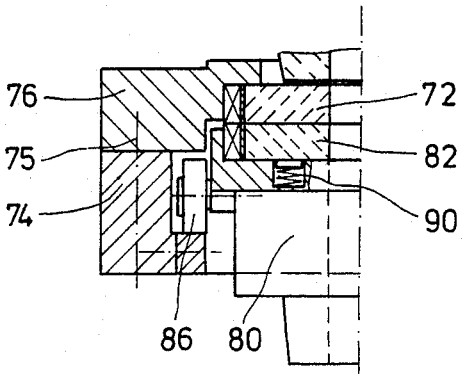
FIG. 6 is a partial transverse cross-sectional view of the slide gate valve of FIG. 5.

The cover 74 is secured in a manner in itself known to the housing 76 by tensioning means 75 not shown in detail herein. As is apparent from FIG. 6, the spring assemblies 90 are supported in the sliding carriage 80 and press in the operating state of the slide gate valve directly on the sliding plate 82. For disassembly of the side gate valve 70, the sliding carriage is first moved to the unstresed position to thereby released the spring assemblies, after which the cover 74 can be released the the housing 76 and the cover and the movable plate assembly can be swung away from housing 76, whereupon the aforementioned maintenance work can be carried out. Upon assembly, after securing the cover 74 to the housing 76, the sliding carriage 80 is tensioned by moving it to the open position or to the closed position S.

I claim:

1. In a sliding closure unit for controlling the discharge of molten metal from a metallurgical vessel, said sliding closure unit including a housing to be attached to the metalurgical vessel and having guides, a stationary refractory plate mounted within said housing and having a discharge opening, a movable plate assembly including a movable refractory plate mounted for sliding movement relative to said housing along said guides between open and closed positions, spring means supported by said housing and acting on said movable plate assembly for urging said movable refractory plate into sealing contact with said stationary refractory plate, and means for, upon release of said spring means, enabling said movable plate assembly to be swung away from said housing, the improvement comprising means for automatically releasing said spring means, said releasing means comprising:

said movable plate assembly being movable relative to said housing to a spring release position beyond and different from said open and closed positions; and said guides having means for, when said movable plate assembly is at said spring release position, allowing said movable plate assembly to be moved by said spring means in a direction away from said stationary refractory plate by a distance sufficient to release the force of said sping means.

2. The improvement claimed in claim 1, wherein said guides have guideway surface supporting said movable plate assembly during movement between said open and closed positions, and wherein said movement allowing means of said guides comprises interruptions of said guideway surfaces.

3. The improvement claimed in claim 2, wherein said guides further have inclined planar surfaces extending between said guideway surfaces and said interruptions.

4. The improvement claimed in claim 2 wherein said movable plate assembly comprises a carriage supporting said movable refractory plate, said carriage having on opposite sides thereof members supported on said guideway surfaces when said carriage is in said open and closed positions and movable into said interruptions when said carriage is moved to said spring release position.

5. The improvement claimed in claim 4, wherein said members comprise two rollers on each said side of said carriage, and said interruptions are of a length greater than the diameter of said rollers.

6. The improvement claimed in claim 5, wherein said interruptions comprise openings through said guides.

7. The improvement claimed in claim 5, wherein said interruptions comprise recesses in said guides.

8. The improvement claimed in claim 4, wherein said housing includes a top section to be attached to the metallurgical vessel, and a housing frame surrounding said carriage, said guides being provided on said housing frame.

9. The improvement claimed in claim 8, wherein said housing frame is connected to said top section by said spring means.

10. The improvement claimed in claim 9, wherein said spring means comprise, on each of opposite sides of said carriage, two spring assemblies arranged symmetrically of and parallel to said discharge opening.

11. The improvement claimed in claim 10, wherein each said spring assembly comprises a bolt member mounted on said top section and having first and second abutment surfaces, said first abutment surface abutting said housing frame, and a spring mounted within said top section and acting on said second abutment surface.

12. The improvement claimed in claim 8, further comprising, on each of two opposite sides of said housing, a bolt fixed to said top section and having a head flexibly supporting said housing frame, said bolts being disposed in a plane extending perpendiculr to the direction of movement of said carriage and containing the axis of said discharge opening.

13. The improvement claimed in claim 8, wherein said housing frame is pivotally connected to said top section to be swung away therefrom, said carriage is pivotally connected to a connecting rod of a drive unit for moving said carriage, and said interruptions comprise recesses in said guides, said recesses being defined by surfaces spaced from and parallel to said guideway surfaces.

14. The improvement claimed in claim 4, wherein said carriage is pivotally connected to connecting rod of a drive unit for moving said carriage, and said interruptions comprise openings through said guides, such that, when said carriage is in said spring release position, said carriage is swingable outwardly of said housing.

15. The improvement claimed in claim 4, wherein said carriage includes a hook member releasably connected to a connecting rod of a driving unit for moving said carriage, said members on said carriage comprise a first pair of rollers mounted coaxialy on an end of said carriage adjacent said hook member and a second pair of rollers mounted coaxaily on an end of said carriage spaced from said hook member, said guides have therein respective grooves into which fit said second pair of rollers when said carriage is in said spring release position, and said interruptions in said guides comprise openings through said guides at positions confronting said first pair of rollers when said carriage is in said spring release position and recesses in said grooves, whereby when said carriage is in said spring release position said carriage is pivotable about the axis of said second pair of rollers.

* * * * *